US011885335B2

(12) United States Patent
Hu et al.

(10) Patent No.: US 11,885,335 B2
(45) Date of Patent: Jan. 30, 2024

(54) OIL SUPPLY MECHANISM OF ROTATING MACHINERY AND ROTATING MACHINERY HAVING OIL SUPPLY MECHANISM

(71) Applicant: EMERSON CLIMATE TECHNOLOGIES (SUZHOU) CO., LTD., Jiangsu (CN)

(72) Inventors: Xiaowei Hu, Suzhou (CN); Lingfeng Ni, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 351 days.

(21) Appl. No.: 17/288,423

(22) PCT Filed: Oct. 23, 2019

(86) PCT No.: PCT/CN2019/112754

§ 371 (c)(1),
(2) Date: Aug. 11, 2021

(87) PCT Pub. No.: WO2020/083309

PCT Pub. Date: Apr. 30, 2020

(65) Prior Publication Data

US 2021/0388836 A1 Dec. 16, 2021

(30) Foreign Application Priority Data

Oct. 24, 2018 (CN) ..... 201811245293.4
Oct. 24, 2018 (CN) ..... 201821730366.4

(51) Int. Cl.
*F04C 29/02* (2006.01)
*F04C 18/02* (2006.01)
(Continued)

(52) U.S. Cl.
CPC ..... *F04C 29/025* (2013.01); *F04C 18/0207* (2013.01); *F04C 29/005* (2013.01); *F04C 29/028* (2013.01); *F04C 2240/603* (2013.01)

(58) Field of Classification Search
CPC ..... F04C 29/02; F04C 29/023; F04C 29/025; F04C 29/028; F04C 18/0215; F04C 23/008
See application file for complete search history.

(56) References Cited

U.S. PATENT DOCUMENTS 6,287,099 B1 9/2001 Chang, II et al.
2007/0224068 A1* 9/2007 Sun ..... F01C 21/02 418/55.1

FOREIGN PATENT DOCUMENTS

CN 1963226 A 5/2007
CN 105899808 A 8/2016
(Continued)

OTHER PUBLICATIONS

International Search Report (English and Chinese) and Written Opinion (Chinese) of the International Searching Authority issued in PCT/CN2019/112754, dated Jan. 23, 2020; ISA/CN (12 pages).

*Primary Examiner* — Deming Wan
(74) *Attorney, Agent, or Firm* — Harness, Dickey & Pierce, P.L.C.

(57) ABSTRACT

An oil supply mechanism comprises: an oil pump device connected to a rotating shaft of a rotating machinery; a main oil supply passage formed in the rotating shaft substantially in the axial direction of the rotating shaft; and a bypass oil passage in communication with the main oil supply passage and allowing a part of lubricating oil in the main oil supply passage to flow out via the bypass oil passage. The bypass oil passage extends in a direction substantially transverse to the rotating shaft. The bypass oil passage is configured such
(Continued)

that a radial distance from an outlet of the bypass oil passage to the axis of the rotating shaft is greater than the radius of the rotating shaft.

17 Claims, 4 Drawing Sheets

(51) Int. Cl.
*F04C 23/00* (2006.01)
*F04C 29/00* (2006.01)

(56) References Cited

FOREIGN PATENT DOCUMENTS

| | | | |
|---|---|---|---|
| CN | 208918841 | U | 5/2019 |
| CN | 208918842 | U | 5/2019 |
| CN | 208934930 | U | 6/2019 |
| WO | WO-2015-182214 | A1 | 12/2015 |
| WO | WO-2016-092688 | A1 | 6/2016 |

* cited by examiner

OIL SUPPLY MECHANISM OF ROTATING MACHINERY AND ROTATING MACHINERY HAVING OIL SUPPLY MECHANISM

CROSS-REFERENCE TO RELATED APPLICATIONS

This application is the national phase of International Application No. PCT/CN2019/112754 titled "OIL SUPPLY MECHANISM OF ROTATING MACHINERY AND ROTATING MACHINERY HAVING OIL SUPPLY MECHANISM" and filed on Oct. 23, 2019, which claims the benefit of priorities to the following two Chinese patent applications: Chinese Patent Application No. 201811245293.4, titled "OIL SUPPLY MECHANISM OF ROTATING MACHINERY AND ROTATING MACHINERY HAVING OIL SUPPLY MECHANISM", filed with the China National Intellectual Property Administration on Oct. 24, 2018; and Chinese Patent Application No. 201821730366.4, titled "OIL SUPPLY MECHANISM OF ROTATING MACHINERY AND ROTATING MACHINERY HAVING OIL SUPPLY MECHANISM", filed with the China National Intellectual Property Administration on Oct. 24, 2018. All of the above applications are incorporated herein by reference in their entireties.

FIELD

The present disclosure relates to an oil supply mechanism of a rotating machinery and a rotating machinery having the oil supply mechanism.

BACKGROUND

The content in this section only provides background information related to the present disclosure, which may not constitute prior art.

In a rotating machinery (such as a scroll compressor), an oil supply mechanism (such as a compressor oil supply mechanism) is generally provided in order to lubricate and cool joining surfaces between various components. In the existing compressor oil supply mechanism, an oil pump is connected to one end of a rotating shaft of the compressor, lubricating oil in an oil sump of the compressor is pumped to an oil supply passage formed in the rotating shaft by the oil pump, and the lubricating oil is supplied through the oil supply passage from the other end of the rotating shaft to the joining surfaces to lubricate and cool corresponding components, for example, to lubricate and cool the joining surface in the compressor mechanism. The oil pump used in the existing compressor oil supply mechanism is generally, for example, a quantitative pump, the oil pump is driven by the rotating shaft of the compressor and pumps the lubricating oil as the rotating shaft of the compressor rotates. The pumping rate of the lubricating oil pumped by the oil pump is proportional to the rotation speed of the rotating shaft of the compressor. When the rotating shaft of the compressor rotates at a low speed, less lubricating oil is pumped from the end of the rotating shaft to the joining surfaces, and when the rotating shaft of the compressor rotates at a high speed, more lubricating oil is pumped from the end of the rotating shaft to the joining surfaces. As the rotation speed of the rotating shaft increases, the pumped lubricating oil continues to increase, so that an oil circulation rate of the lubricating oil is relatively high under a high-speed operating condition, which results in relatively low efficiency of the compressor, thereby resulting in the relatively low efficiency of the entire system. If the oil circulation rate under the high-speed operating condition is reduced by reducing the volume of the oil pump, the oil circulation under a low-speed operating condition may also be proportionally reduced, which may cause an insufficient lubrication and thereby causing a problem of wear of the compressor components.

Therefore, it is necessary to improve the existing oil supply mechanism of the rotating machinery, so that the oil supply mechanism can not only ensure the lubrication requirement under a low-speed operating condition, but also ensure a relatively low oil circulation rate under a high-speed operating condition, and improves the performance of the rotating machinery.

SUMMARY

An object of the present disclosure is to solve or improve one or more of the above problems.

One aspect according to the present disclosure is to provide an oil supply mechanism of a rotating machinery including a rotating shaft. The oil supply mechanism includes a main oil supply passage formed in the rotating shaft substantially in an axial direction of the rotating shaft; and a bypass oil passage in communication with the main oil supply passage and allowing a part of lubricating oil in the main oil passage to flow out via the bypass oil passage. The bypass oil passage extends in a direction substantially transverse to the rotating shaft, and the bypass oil passage is configured such that a radial distance between an outlet of the bypass oil passage and an axis of the rotating shaft is greater than a radius of the rotating shaft.

In an embodiment, a ratio of the radial distance to the radius ranges from 2 to 5. Preferably, the ratio ranges from 2.5 to 4.

In an embodiment, the bypass oil passage includes a first passage portion and a second passage portion connected to each other, the first passage portion is in direct fluid communication with the main oil supply passage, and a cross-sectional area of the first passage portion is greater than a cross-sectional area of the second passage portion so that the bypass oil passage is formed as a stepped passage.

In an embodiment, the bypass oil passage is constructed by forming an integral radial protrusion at the rotating shaft, and/or the bypass oil passage is constructed by providing an additional oil passage member.

In an embodiment, a first through hole extending in a direction substantially transverse to the rotating shaft is formed in the rotating shaft, the additional oil passage member is provided with a second through hole extending in an axial direction of the additional oil passage member, the additional oil passage member is attached to the rotating shaft to allow the second through hole to be in direct communication with the main oil supply passage or be in indirect communication with the main oil supply passage via the first through hole, and at least a portion of the bypass oil passage is formed by the second through hole.

The additional oil passage member is inserted into the first through hole so that the first through hole is completely occupied by the additional oil passage member, and the bypass oil passage is formed by the second through hole. Alternatively, the additional oil passage member is inserted into the first through hole so that the first through hole is partially occupied by the additional oil passage member, and the bypass oil passage is formed by the second through hole and a portion of the first through hole. Alternatively, the additional oil passage member is attached to an outer peripheral wall surface of the rotating shaft in a manner without being inserted into the first through hole, and the bypass oil passage is formed by the first through hole and the second through hole.

In an embodiment, a cross-sectional area of the first through hole is greater than a cross-sectional area of the second through hole, so that the bypass oil passage is formed as a stepped passage: and/or the first through hole and/or the second through hole are formed with a stepped portion, so that the bypass oil passage is formed as a stepped passage in which a passage portion in direct communication with the main oil supply passage has a larger cross-sectional area.

In an embodiment, the additional oil passage member is provided with a stop portion, and the stop portion is abutted against an outer peripheral wall surface of the rotating shaft when the additional oil passage member is attached to the rotating shaft.

In an embodiment, a portion of the outer peripheral wall surface of the rotating shaft abutting against the stop portion is formed as a plane portion.

In an embodiment, the additional oil passage member is a pin.

The oil supply mechanism further includes an oil pump device, and the oil pump device is coupled with the rotating shaft to pump the lubricating oil into the main oil supply passage.

A lower end portion of the rotating shaft is supported by a bottom bearing, and the main oil supply passage includes a central oil passage connected to the oil pump device and an eccentric oil passage extending upward from the central oil passage, the central oil passage is connected to and in communication with the eccentric oil passage in a joint area. The bypass oil passage is located below the joint area and above the bottom bearing in the axial direction of the rotating shaft, and the bypass oil passage is in communication with the central oil passage.

In an embodiment, the bypass oil passage is arranged on the same side as the eccentric oil passage in a circumferential direction of the rotating shaft.

An aspect of the present disclosure is to provide rotating machinery including the oil supply mechanism according to the present disclosure.

In an embodiment, the rotating machinery is a scroll compressor.

In the present disclosure, an elongated bypass oil passage is provided in an oil supply mechanism of a rotating machinery. The bypass oil passage has a relatively low drainage capacity under a low-speed operating condition, so as to ensure the oil supply amount under the low-speed operating condition, and meet the lubrication requirement. In addition, the bypass oil passage has a relatively high drainage capacity under a high-speed operating condition, so as to reduce the oil supply amount under the high-speed operating condition, reduce oil circulation rate, and improve the efficiency of the rotating machinery.

BRIEF DESCRIPTION OF THE DRAWINGS

Hereinafter, the embodiments of the present disclosure will be described only by the way of examples with reference to the accompanying drawings, in which the same features or components are denoted by the same reference numerals and the accompanying drawings are not necessarily drawn to scale, and in the accompanying drawings.

DETAILED DESCRIPTION OF EMBODIMENTS

Figure 1:
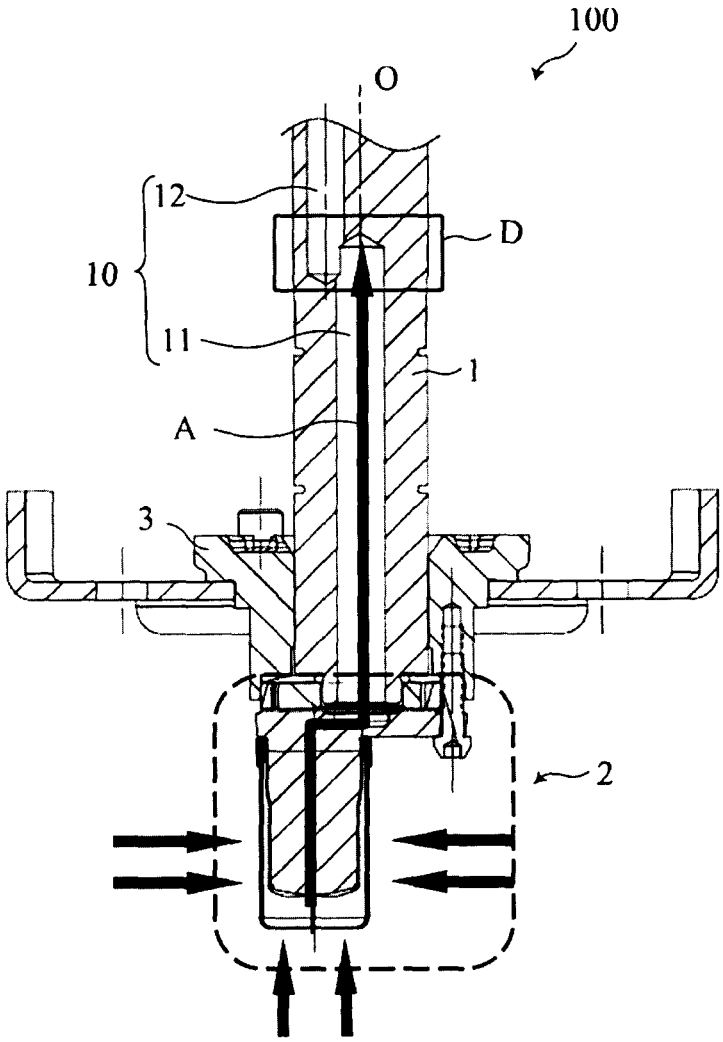
FIG. 1 is a schematic sectional view of a compressor oil supply mechanism of a comparative example.

The following description is merely exemplary in nature and is not intended to limit the present disclosure, the application and usage thereof. It should be noted that in all these drawings, similar reference numerals indicate the same or similar components and features. The drawings only schematically show the inventive concept and principle of the embodiments of the present disclosure, and do not necessarily show the specific dimensions and proportions of the various embodiments of the present disclosure. An exaggerated manner may be used in specific parts of the specific drawings to illustrate related details or structures of the embodiments of the present disclosure.

In this specification, a rotating machinery refers to a mechanical device or system having a rotating shaft, a crankshaft, or a rotating drive shaft. A compressor with a rotating shaft belongs to the rotating machinery described herein. Hereinafter, a compressor (such as a scroll compressor) is taken as an example of the rotating machinery to describe an oil supply mechanism of a rotating machinery of a comparative example and an oil supply mechanism of a rotating machinery according to the present disclosure, so as to illustrate the inventive concept of the present disclosure. However, it should be noted that the oil supply mechanism according to the present disclosure is also applicable to other rotating machinery including a rotating shaft, a crankshaft, or a rotating drive shaft and an oil pump device coupled with the rotating shaft, the crankshaft, or the rotating drive shaft.

FIG. 1 shows a schematic sectional view of a compressor oil supply mechanism 100 according to a comparative example, which is an example of the oil supply mechanism of the rotating machinery in this specification. As shown in FIG. 1, the compressor oil supply mechanism 100 includes an oil pump device 2 and a main oil supply passage 10 formed in a rotating shaft 1 of the compressor. The oil pump device 2 is an oil pump, and is generally a quantitative pump. The main oil supply passage 10 of the compressor oil supply mechanism 100 is composed of a central oil passage 11 and an eccentric oil passage 12 together. The central oil passage 11 is formed in the center of the rotating shaft 1 of the compressor, extends through a lower end portion of the rotating shaft 1 and is in fluid communication with the oil pump device 2. The eccentric oil passage 12 is also formed in the rotating shaft 1, deviates from an axis (longitudinal center axis) O of the rotating shaft 1 and extends along an axial direction of the rotating shaft 1. One end of the eccentric oil passage 12 is connected to and in communication with an upper end portion of the central oil passage 11 in a joint area D, and the other end of the eccentric oil passage 12 extends through an upper end portion (not shown) of the rotating shaft 1. A lower end portion of the rotating shaft 1 of the compressor is supported by a bottom bearing 3 of the compressor. The oil pump device 2 is coupled with the lower end portion of the rotating shaft 1 of the compressor, and is driven by the rotating shaft 1. When the rotating shaft 1 rotates, the oil pump device 2 starts up, and as shown by the double-row arrows in FIG. 1, lubricating oil in an oil sump of the compressor is sucked into the oil pump device 2, and is pumped through oil passages inside the oil pump device 2 to the central oil passage 11 inside the rotating shaft 1, as shown by arrow A. The lubricating oil in the central oil passage 11 is thrown into the eccentric oil passage 12 under the action of centrifugal force, and for example, passes through the upper end portion of the rotating shaft 1 and is transported to joining surfaces, so as to lubricate and cool the corresponding components of the compressor. It should be noted here that in the compressor oil supply mechanism 100 of the comparative example and the compressor oil supply mechanism 200 according to the present disclosure to be described below, the oil pump device 2 may be an oil pump such as a rotary pump, or a simpler oil pump device capable of moving with the rotation of a rotating shall so as to pump oil to the central oil passage, such as an oil fork.

Figure 2:
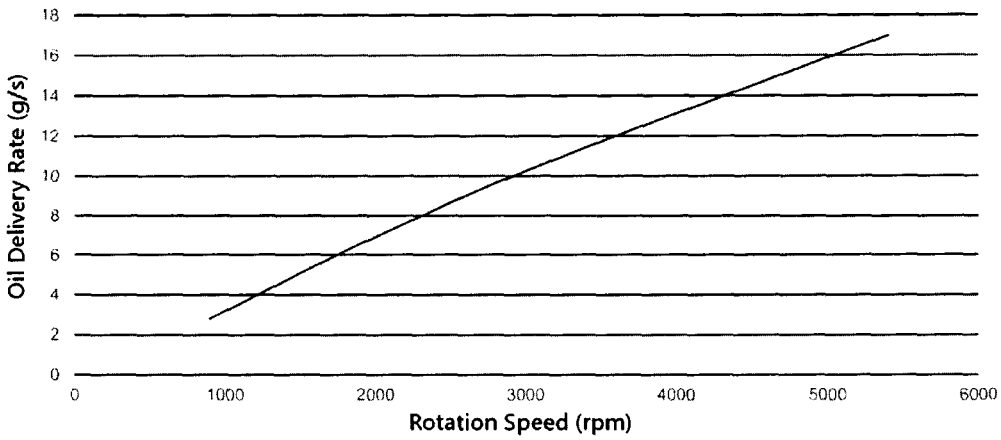
FIG. 2 is a schematic diagram of the relationship between the oil delivery rate of the compressor oil supply mechanism and the rotation speed of a rotating shaft of the compressor of the comparative example.

The oil delivery rate or oil delivery amount of the lubricating oil pumped by the oil pump device 2 flowing out from the upper end portion of the rotating shaft 1 is proportional to the rotation speed of the rotating shaft 1. FIG. 2 shows the relationship between the oil delivery rate of the lubricating oil pumped by the oil pump device 2 flowing out from the upper end portion of the rotating shaft 1 (hereinafter referred to as "the oil delivery rate of the compressor oil supply mechanism") and the rotation speed of the rotating shaft 1. As shown in FIG. 2, when the rotating shaft 1 rotates at a low speed, the oil delivery rate of the compressor oil supply mechanism 100 is relatively low, and when the rotating shaft 1 rotates at a high speed, the oil delivery rate of the compressor oil supply mechanism 100 is relatively high. As the rotation speed of the rotating shaft 1 increases, the oil delivery rate of the compressor oil supply mechanism 100 continuously increases linearly. Therefore, the oil circulation rate (used to characterize an oil amount which enters the compressor mechanism and then enters an outside of the system) of the lubricating oil is relatively high under a high-speed operating condition, which results in relatively low efficiency of the compressor, affects the performance of the compressor, and also affects the performance of the entire system. In this specification, the oil circulation rate is used to characterize the oil amount which enters the compressor mechanism and then is discharged outside the system, and refers to the proportion of the lubricating oil contained in compressor discharged gas. In order to facilitate the management of the compressor lubricating oil and improve the reliability and performance of the application system, the oil circulation rate is generally desired to be reduced.

As shown in FIG. 2, the oil delivery rate of the compressor oil supply mechanism 100 has a substantially linear relationship with the rotation speed of the rotating shaft 1. If the oil circulation rate under the high-speed operating condition is reduced only by reducing the volume of the quantitative pump, the oil circulation rate under a low-speed operating condition may be proportionally reduced, so that the lubrication requirement cannot be met under the low-speed operating condition, resulting in an insufficient lubrication and thereby accelerating wear.

The inventor is aware of the above problems and proposes a compressor oil supply mechanism which is capable of solving the above technical problems. The oil supply mechanism according to the inventive concept of the present disclosure is provided with an elongated bypass oil passage, which can not only meet the lubrication requirement under the low-speed operating condition, but also reduce the oil circulation rate under the high-speed operating condition, and reduce the proportion of the lubricating oil contained in the compressor discharged gas. On one hand, it is beneficial to the capacity of the entire refrigeration/heating cycle, which improves the efficiency of the heat exchanger, and on the other hand, it is beneficial to maintaining the internal oil amount inside the compressor and improving the reliability of the compressor operation, which is beneficial to the management of the lubricating oil of the compressor, thereby improving the efficiency and reliability of the compressor, and improving the performance of the compressor. The compressor oil supply mechanism according to an embodiment of the present disclosure will be described below with reference to the accompanying drawings.

Figure 3:
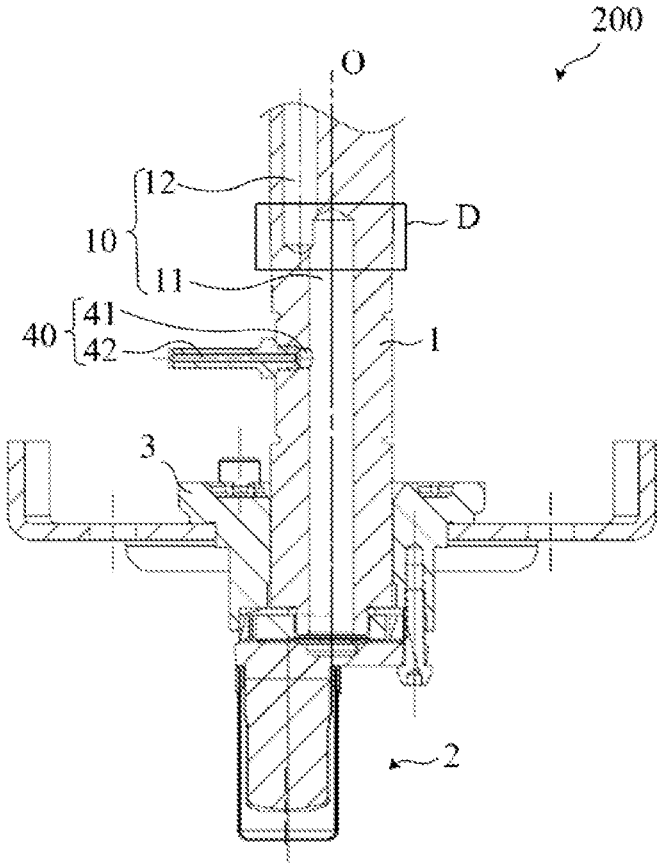
FIG. 3 is a schematic sectional view of a compressor oil supply mechanism according to an embodiment of the present disclosure.
Figure 4:
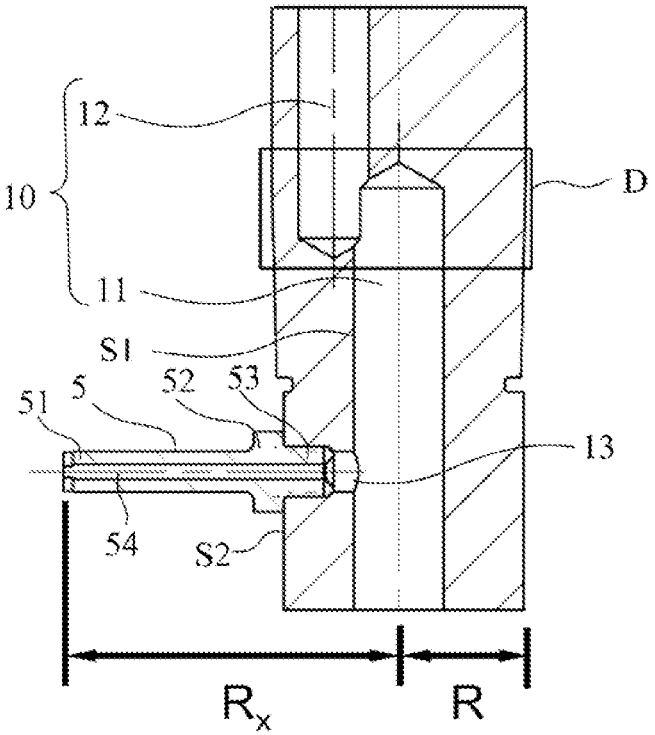
FIG. 4 is a partial enlarged view of the sectional view shown in FIG. 3.

FIGS. 3 and 4 show schematic sectional views of the compressor oil supply mechanism 200 according to an embodiment of the present disclosure. In the compressor oil supply mechanism 200 according to the present disclosure, the same components as the components of the compressor oil supply mechanism 100 of the comparative example are denoted by the same reference numerals, and the description thereon will not be repeated. Hereinafter, only the differences between the compressor oil supply mechanism 200 according to the present disclosure and the compressor oil supply mechanism 100 of the comparative example will be described in detail.

As shown in FIG. 3, the compressor oil supply mechanism 200 includes an oil pump device 2 and a main oil supply passage 10, and the main oil supply passage 10 is composed of a central oil passage 11 and an eccentric oil passage 12 together. In addition, the compressor oil supply mechanism 200 further includes a bypass oil passage 40. The bypass oil passage 40 is in fluid communication with the main oil supply passage 10, so that a part of lubricating oil in the main oil supply passage 10 flows out of a rotating shaft 1 through the bypass oil passage 40 and returns to an oil sump at the bottom of the compressor. Specifically, the bypass oil passage 40 is arranged between a bottom bearing section and a motor section of the rotating shall 1, and is in communication with the central oil passage 11. In this specification, the bottom bearing section of the rotating shaft 1 refers to a section of the rotating shaft 1 cooperating with the bottom bearing 3, and the motor section of the rotating shaft 1 refers to a section of the rotating shaft 1 cooperating with the motor (not shown). That is, the bypass oil passage 40 is located above the bottom bearing 3 and below the motor in an axial direction of the rotating shaft 1. The bypass oil passage 40 includes a first passage portion 41 and a second passage portion 42 connected to each other, and the second passage portion 42 is in communication with the central oil passage 11 via the first passage portion 41.

In the illustrated exemplary embodiment, a first through hole 13 is provided in the rotating shaft 1. The first through hole 13 extends through a wall of the rotating shaft 1 in a radial direction of the rotating shaft 1, so that the central oil passage 11 is in communication with an outside of the rotating shaft 1. In the axial direction of the rotating shaft 1, the first through hole 13 is arranged below a joint area D for the central oil passage 11 and the eccentric oil passage 12, and is in direct fluid communication with the central oil passage 11, and is as far away from the joint area D as possible, so as to ensure that the first through hole 13 is arranged as low as possible while the first through hole 13 is located above the bottom bearing. In a circumferential direction of the rotating shaft 1, the first through hole 13 is arranged on the same side with the eccentric oil passage 12. Alternatively, the first through hole 13 may be away from the eccentric oil passage 12 in the circumferential direction, so as to ensure a stable oil supply.

The compressor oil supply mechanism 200 further includes an additional oil passage member. In this exemplary embodiment, a pin 5 is used as the additional oil passage member, and is attached to the rotating shaft 1. A second through hole 54 is formed in the pin 5, and extends in an axial direction of the pin 5 through an entire axial length of the pin 5. In the illustrated exemplary embodiment, the first through hole 13 is a threaded hole and has a uniform cross-sectional area over an entire length of the first through hole 13. A first end 53 of the pin 5 is threaded into the first through hole 13. It should be noted that the present disclosure is not limited to this. In other possible embodiments of the present disclosure, the pin 5 may be inserted into the first through hole 13 in other ways. For example, the first through hole 13 may be formed as an unthreaded hole, and the pin 5 may be interference-fitted in the first through hole 13. The first end 53 of the pin 5 extends into substantially half of the length of the first through hole 13, and does not reach an inner peripheral wall surface S1 of the rotating shaft 1, so that a portion of the first through hole 13 does not engage with the pin 5. That is, the first through hole 13 is partially occupied by the pin 5. It should be noted here that the additional oil passage member according to the present disclosure may also be implemented as other suitable members with through holes (for example, a circular pipe).

The first passage portion 41 of the bypass oil passage 40 is formed by a portion of the first through hole 13 which does not engage with the pin 5, and the second passage portion 42 is formed by the second through hole 54 in the pin 5. This arrangement allows a radial distance between an outlet of the bypass oil passage 40 and an axis (longitudinal axis O) of the rotating shaft 1 to be greater than a radius of the rotating shaft 1, so that the bypass oil passage 40 is constructed as an elongated bypass oil passage. In addition, the cross-sectional area of the first through hole 13 that is, a cross-section area of the first passage portion 41 in this embodiment) is greater than a cross-sectional area of the second through hole 54 (that is, the second passage portion 42 in this embodiment), so that the bypass oil passage 40 is formed as a stepped passage. This configuration allows a part of the lubricating oil in the central oil passage 11 to be stored in the first passage portion 41 with a relatively larger cross-sectional area during the rotation of the rotating shaft 1, so as to ensure that the lubricating oil is able to be stably and reliably discharged from the bypass oil passage 40 at different rotation speeds of the rotating shaft 1.

As shown in FIG. 4, the pin 5 is provided with a stop portion 52. The stop portion 52 is located between a second end portion 51 and the first end portion 53. The stop portion 52 is abutted against an outer peripheral wall surface S2 of the rotating shall 1 when the pin 5 is attached to the rotating shaft 1, so as to prevent the pin 5 from being excessively inserted into the first through hole 13. Preferably, a portion of the outer peripheral wall surface S2 of the rotating shaft 1 abutting against the stop portion 52 is formed as a plane portion, so as to facilitate assembly. It should be noted that the stop portion 52 is not essential. In other possible embodiments of the present disclosure, the stop portion may be not provided. Alternatively, in other embodiments of the present disclosure, an outer contour of the pin 5 may be configured such that the stop portion 52 extends over the entire second end portion 51, instead of being formed only at a portion between the two end portions.

Figure 5:
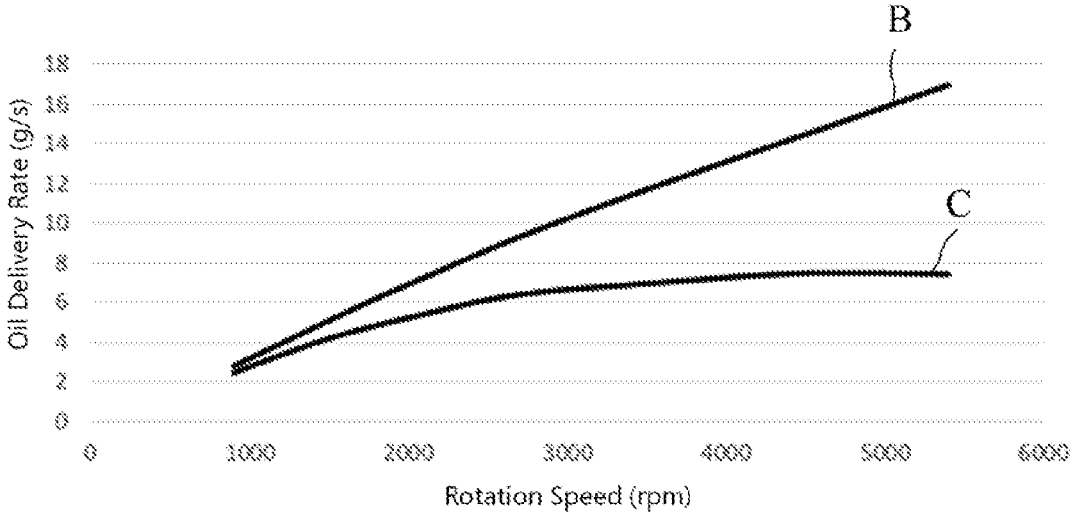
FIG. 5 is a schematic diagram showing the relationship between the oil delivery rate of the compressor oil supply mechanism and the rotation speed of the rotating shaft of the compressor according to the embodiment of the present disclosure, and FIG. 5 also shows the relationship between the oil delivery rate of the compressor oil supply mechanism and the rotation speed of the rotating shaft of the compressor of the comparative example.

FIG. 5 shows a schematic diagram of the relationship between the oil delivery rate of the compressor oil supply mechanism and the rotation speed of the rotating shaft 1. In FIG. 5, a line C shows the relationship between the oil delivery rate of the compressor oil supply mechanism 200 and the rotation speed of the rotating shaft 1 according to this exemplary embodiment, and a line B shows the relationship between the oil delivery rate of the compressor oil supply mechanism 100 and the rotation speed of the rotating shaft 1 of the comparative example. As shown in FIG. 5, in the process of gradually increasing the rotation speed of the rotating shaft 1, the oil delivery rate of the compressor oil supply mechanism 200 according to the present disclosure increases gradually first. When the rotating shaft 1 rotates at a high speed, for example, when the rotation speed of the rotating shaft 1 exceeds 3000 rpm, the oil delivery rate of the compressor oil supply mechanism 200 increases by a small amount, and tends to be constant with further increasing of the rotation speed of the rotating shaft 1. When the rotating shaft 1 rotates at a low speed, the oil drainage capacity of the bypass oil passage 40 is relatively low, the oil delivery rate of the compressor oil supply mechanism 200 is substantially the same as the oil delivery rate of the compressor oil supply mechanism 100, and when the rotating shaft 1 rotates at a high speed, the oil drainage capacity of the bypass oil passage 40 is relatively high, and the oil delivery rate of the compressor oil supply mechanism 200 is significantly lower than the oil delivery rate of the compressor oil supply mechanism 100, which significantly reduces the oil circulation rate. Therefore, compared with the compressor oil supply mechanism 100, the compressor oil supply mechanism 200 according to the present disclosure can not only ensure the oil supply amount under the low-speed operating condition so as to meet the lubrication requirement, but also can significantly reduce the oil circulation rate under the high-speed operating condition, increasing the efficiency of the compressor and improving the performance of the compressor. That is, by providing the elongated bypass oil passage 40, in particular, by providing the elongated bypass oil passage (especially, the bypass oil passage having an appropriate cross-sectional area, such as a relatively small cross-sectional area) with a radial dimension (radial distance between the outlet of the bypass oil passage and the axis of the rotating shaft) greater than the radius (original radius) of the rotating shaft, the bypass oil passage 40 has a relatively low oil drainage capacity when the rotating shaft 1 rotates at a low speed, and has a relatively high oil drainage capacity when the rotating shaft 1 rotates at a high speed. As a result, the lubricating requirement under the low-speed operating condition can be ensured, and the oil circulation rate under the high-speed operating condition can be reduced. In this specification, the radius of the rotating shaft 1 is a radius of the shaft portion of the rotating shaft 1 provided with the bypass oil passage, and in a case that the elongated bypass oil passage is formed by such as providing an integral radial protruding portion at a circumferential portion of the shaft portion, without the aid of a pin, the radius of the rotating shaft 1 is a radius (that is, an original radius) of a circumferential portion without the radial protruding portion, of the shaft portion. Therefore, the radius of the rotating shaft 1 may also be referred to as the original radius so as to distinguish from the increased new radius at the radial protrusion.

The inventor further discovers that the length of the pin 5 or the radial dimension of the bypass oil passage 40 may affect the relationship characteristics between the oil delivery rate of the compressor oil supply mechanism 200 and the rotation speed of the rotating shaft 1.

Figure 6:
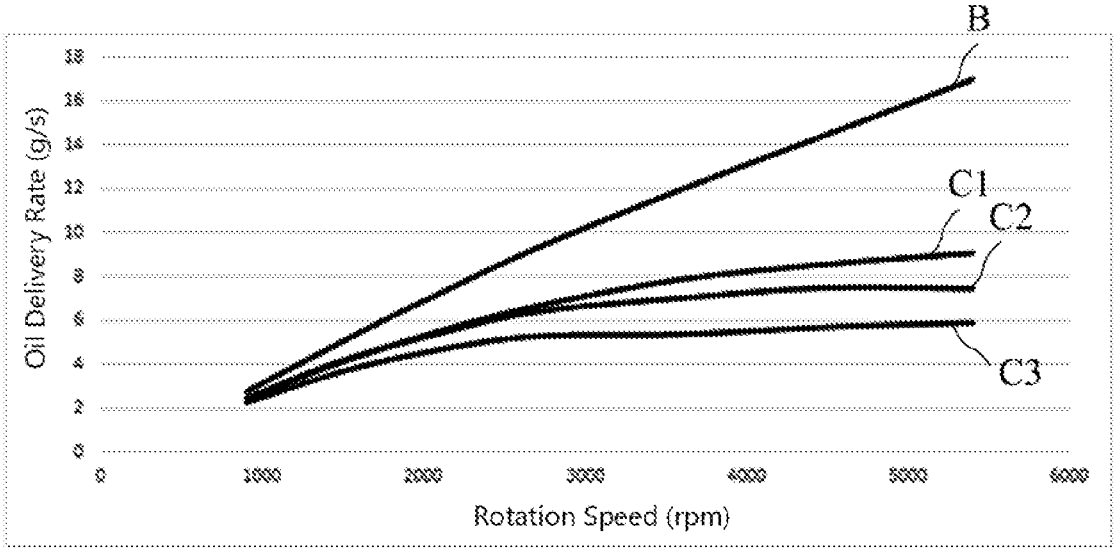
FIG. 6 is a schematic diagram showing the relationship between the oil delivery rates of the compressor oil supply mechanisms with different parameters and the rotation speed of the rotating shaft of the compressor according to the present disclosure.

As shown in FIG. 4, a distance between the end surface of the second end portion 51 (the end farther from the central oil passage 11) of the pin 5 and the axis O of the rotating shaft 1 is Rx (corresponding to the radial diameter of the bypass oil passage), and the radius of the rotating shaft 1 is R. The inventor finds that a ratio P between the distance Rx and the radius R may affect the relationship characteristics between the oil delivery rate of the compressor oil supply mechanism 200 and the rotation speed of the rotating shaft 1. Firstly, as described above, in a case that the distance Rx is greater than the radius R, the oil drainage capacity of the bypass oil passage 40 is relatively low when the rotating shaft rotates at the low speed, and the oil drainage capacity is relatively high when the rotating shaft rotates at the high speed. On this basis, specifically, in a case that other parameters and operating conditions are the same, the larger the ratio P is, the smaller the oil delivery rate of the compressor oil supply mechanism 200 under the high-speed operating condition is, and the smaller the oil circulation rate is. Preferably, the ratio P between the distance Rx and the radius R of the rotating shaft 1 ranges from 2 to 5, so as to ensure that the compressor has an appropriate oil circulation rate (that is, avoiding excessive oil circulation rate, meanwhile ensuring that the oil circulation rate is not lower than a lower limit of the oil circulation rate required to ensure the lubrication of the compressor) under the high-speed operating condition, and to improve the efficiency of the compressor and the entire system as much as possible under the condition of ensuring sufficient lubrication. More preferably, the ratio P between the distance Rx and the radius R of the rotating shaft 1 ranges from 2.5 to 4. FIG. 6 shows a schematic diagram of the relationship between the oil delivery rates of the compressor oil supply mechanisms with different ratios P and the rotation speed of the rotating shaft according to the present disclosure. In FIG. 6, a line B represents the relationship between the oil delivery rate of the compressor oil supply mechanism 100 and the rotation speed of the rotating shaft of the comparative example, and lines C1, C2 and C3 respectively represent the relationship between the oil delivery rate of the compressor oil supply mechanism in which the ratio P is P1, P2, and P3 respectively and the rotation speed of the rotating shall according to the present disclosure, where P1<P2<P3. It can be seen from FIG. 6 that the greater the ratio P is, the smaller the oil delivery rate under the high-speed operating condition is, and the higher the efficiency of the compressor is.

The compressor oil supply mechanism according to the preferred embodiment of the present disclosure is shown above. In the embodiment shown above, in order to facilitate processing, the first through hole 13 is a threaded hole having the uniform diameter and extends in the axial direction of the rotating shall 1. The first end portion 53 of the pin 5 is threaded with the first through hole 13 on a portion of the length of the first through hole 13, without being inserted to reach the inner peripheral wall surface S1 of the rotating shaft 1 (that is, the pin 5 is inserted so as to not allow an end surface of the first end portion 53 to reach the inner peripheral wall surface S1 to be flush with the inner peripheral wall surface S1, so that the first through hole 13 is partially occupied by the pin 5), the first passage portion 41 of the bypass oil passage 40 is formed by a portion of the first through hole 13 which is not engaged with the pin 5, and the second passage portion 42 is formed by the second through hole 54 in the pin 5. In addition, the first through hole 13 in the rotating shaft 1 is arranged below the joint area D for the central oil passage 11 and the eccentric oil passage 12, and the first through hole 13 is arranged close to the eccentric oil passage 12 in the circumferential direction. However, the present disclosure is not limited to this.

In other possible embodiments of the present disclosure, the first through hole 13 may extend not in the radial direction of the rotating shaft 1, but in a direction tangent to the central oil passage 11. In addition, in other possible embodiments of the present disclosure, the first through hole 11 may be formed not in a plane perpendicular to the axis O of the rotating shaft 1, but may be formed to be slightly inclined upward or downward relative to the plane perpendicular to the axis O of the rotating shaft 1. Here, the expression "the bypass oil passage or the first through hole is substantially transverse to the rotating shaft" used in the specification can be used to mean that: the bypass oil passage 40 or the first through hole 13 extends in the radial direction of the rotating shaft 1 (extending in the radial direction away from the axis of the rotating shaft); the bypass oil passage 40 or the first through hole 13 extends in the direction tangent to the central oil passage 11; and the bypass oil passage 40 or the first through hole 13 extends slightly inclined upward or downward relative to the plane perpendicular to the axis O of the rotating shaft 1. Here, the bypass oil passage 40 or the first through hole 13 extends slightly inclined upward or downward relative to the plane perpendicular to the axis O of the rotating shaft 1" means that the bypass oil passage 40 or the first through hole 13 does not have to be strictly perpendicular to the axis O of the rotating shaft 1, but may, for example, be inclined relative to the plane perpendicular to the axis O of the rotating shall 1 within the allowable range of machining error.

In other possible embodiments of the present disclosure, the first through hole 13 may also be formed as a stepped through hole, and a portion thereof with a relative larger cross-sectional area is close to the central oil passage 11. And in a case that the wall of the rotating shaft 1 is thick enough (for example, an integral radial protruding portion is provided at the axial portion and the circumferential portion of the rotating shaft 1), the pin 5 can even be omitted.

In other possible embodiments of the present disclosure, the first end portion 53 of the pin 5 may engage with the first through hole 13 on the entire length of the first through hole 13 and be flush with the inner peripheral wall surface S1 of the rotating shaft 1, so that the first through hole 13 is completely occupied by the pin 5. In this embodiment, the first passage portion 41 and the second passage portion 42 of the bypass oil passage 40 are respectively formed by the corresponding portions of the second through hole 54 in the pin 5. The second through hole 54 may be a through hole with a constant cross-sectional area, so that the first passage portion 41 and the second passage portion 42 may have the same cross-sectional area (that is, the bypass oil passage 40 is not formed as a stepped passage). However, preferably, the second through hole 54 is formed as a stepped hole, so that the cross-sectional area of the first passage portion 41 is greater than the cross-sectional area of the second passage portion 42, so as to ensure that the lubricating oil is stably and reliably discharged from the bypass oil passage 40 at different rotation speeds.

In other possible embodiments of the present disclosure, the first end portion 53 of the pin 5 may not be inserted into the first through hole 13, but be sealingly abutted against the outer peripheral wall surface S2 of the rotating shaft 1, and the second through hole 54 in the pin 5 is aligned with the first through hole 13. In this case, the first passage portion 41 of the bypass oil passage 40 is formed by the first through hole 13 or is formed by the first through hole 13 and a portion of the second through hole 54 together, and the second passage portion 42 of the bypass oil passage 40 is formed by the second through hole 54 or is formed by a portion of the second through hole 54. Preferably, the cross-sectional area of the first through hole 13 is greater than the cross-sectional area of the second through hole 54. Preferably, the second through hole 54 is formed as a stepped hole, and the cross-sectional area of the first through hole 13 is greater than or equal to the cross-sectional area of the portion of the second through hole 54 with relative larger cross-sectional area.

In other possible embodiments of the present disclosure, the first through hole 13 is arranged below the joint area D, and is arranged at any position in the circumferential direction of the rotating shaft 1, and is not limited to being arranged close to the eccentric oil passage 12 in the circumferential direction.

In other possible embodiments of the present disclosure, the first through hole 13 may also be arranged close to the joint area D. In this case, due to the arrangement of the eccentric oil passage 12, the first through hole 13 is provided to avoid a position that is close to the joint area D and 180 degrees away from the eccentric oil passage 12 in the circumferential direction. That is, in this case, the first through hole 13 needs to be arranged close to the eccentric oil passage 12 in the circumferential direction.

The exemplary embodiments of the present disclosure have been described in detail here. It should be understood that the present disclosure is not limited to the specific embodiments described and shown in detail herein, and other modifications and variations may be implemented by those skilled in the art without departing from the spirit and scope of the present disclosure. All these modifications and variations fall within the scope of the present disclosure. Moreover, all the components described herein can be replaced by other technically equivalent components.

The invention claimed is:

1. An oil supply mechanism of a rotating machinery comprising a rotating shaft, the oil supply mechanism comprising:

a main oil supply passage formed in the rotating shaft substantially in an axial direction of the rotating shaft; and a bypass oil passage in communication with the main oil supply passage and allowing a part of lubricating oil in the main oil passage to flow out via the bypass oil passage, wherein the bypass oil passage extends substantially transversely to the rotating shaft, and the bypass oil passage is configured such that a radial distance between an outlet of the bypass oil passage and an axis of the rotating shaft is greater than a radius of the rotating shaft, wherein the bypass oil passage comprises a first passage portion and a second passage portion connected to each other, the first passage portion is in direct fluid communication with the main oil supply passage, and a cross-sectional area of the first passage portion is greater than a cross-sectional area of the second passage portion so that the bypass oil passage is formed as a stepped passage.

2. The oil supply mechanism according to claim 1, wherein a ratio of the radial distance to the radius ranges from 2 to 5.

3. The oil supply mechanism according to claim 2, wherein the ratio ranges from 2.5 to 4.

4. The oil supply mechanism according to claim 3, wherein the bypass oil passage is constructed by forming an integral radial protrusion at the rotating shaft, and/or wherein the bypass oil passage is constructed by providing an additional oil passage member.

5. The oil supply mechanism according to claim 2, wherein the bypass oil passage is constructed by forming an integral radial protrusion at the rotating shaft, and/or wherein the bypass oil passage is constructed by providing an additional oil passage member.

6. The oil supply mechanism according to claim 1, wherein the bypass oil passage is constructed by forming an integral radial protrusion at the rotating shaft, and/or wherein the bypass oil passage is constructed by providing an additional oil passage member.

7. The oil supply mechanism according to claim 6, wherein:

a first through hole extending substantially transversely to the rotating shaft is formed in the rotating shaft, the additional oil passage member is provided with a second through hole extending in an axial direction of the additional oil passage member, the additional oil passage member is attached to the rotating shaft to allow the second through hole to be in direct communication with the main oil supply passage or to be in indirect communication with the main oil supply passage via the first through hole, and at least a portion of the bypass oil passage is formed by the second through hole.

8. The oil supply mechanism according to claim 7, wherein:

the additional oil passage member is inserted into the first through hole so that the first through hole is completely occupied by the additional oil passage member, and the bypass oil passage is formed by the second through hole; or the additional oil passage member is inserted into the first through hole so that the first through hole is partially occupied by the additional oil passage member, and the bypass oil passage is formed by the second through hole and a portion of the first through hole; or the additional oil passage member is attached to an outer peripheral wall surface of the rotating shaft in a manner without being inserted into the first through hole, and the bypass oil passage is formed by the first through hole and the second through hole.

9. The oil supply mechanism according to claim 7, wherein:

a cross-sectional area of the first through hole is greater than a cross-sectional area of the second through hole, so that the bypass oil passage is formed as a stepped passage; and/or the first through hole and/or the second through hole are formed with a stepped portion, so that the bypass oil passage is formed as a stepped passage in which a passage portion in direct communication with the main oil supply passage has a larger cross-sectional area.

10. The oil supply mechanism according to claim 7, wherein the additional oil passage member is provided with a stop portion, and the stop portion is abutted against an outer peripheral wall surface of the rotating shaft when the additional oil passage member is attached to the rotating shaft.

11. The oil supply mechanism according to claim 10, wherein a portion of the outer peripheral wall surface of the rotating shaft abutting against the stop portion is formed as a plane portion.

12. The oil supply mechanism according to claim 7, wherein the additional oil passage member is a pin.

13. The oil supply mechanism according to claim 1, wherein the oil supply mechanism further comprises an oil pump device, and the oil pump device is coupled with the rotating shaft to pump the lubricating oil into the main oil supply passage.

14. The oil supply mechanism according to claim 13, wherein:

a lower end portion of the rotating shaft is supported by a bottom bearing, and the main oil supply passage comprises a central oil passage connected to the oil pump device and an eccentric oil passage extending upward from the central oil passage, the central oil passage is connected to and in communication with the eccentric oil passage in a joint area, and the bypass oil passage is located below the joint area and above the bottom bearing in the axial direction of the rotating shaft, and the bypass oil passage is in communication with the central oil passage.

15. The oil supply mechanism according to claim 14, wherein the bypass oil passage is arranged on the same side as the eccentric oil passage in a circumferential direction of the rotating shaft.

16. A rotating machinery, wherein the rotating machinery comprises the oil supply mechanism according to claim 1.

17. The rotating machinery according to claim 16, wherein the rotating machinery is a scroll compressor.

* * * * *